US005309656A

United States Patent [19]

Montgomery

[11] Patent Number: 5,309,656

[45] Date of Patent: May 10, 1994

[54] FLASHING SIGN

[76] Inventor: Richard Montgomery, P.O. Box 8641, Amarillo, Tex. 79114

[21] Appl. No.: 879,981

[22] Filed: May 6, 1992

[51] Int. Cl.[5] ..... G09F 13/02

[52] U.S. Cl. ..... 40/442; 40/575; 40/902

[58] Field of Search ..... 40/564, 442, 544, 572, 40/575, 902; 362/812; 340/815.03, 815.06, 815.07, 815.15, 815.17

[56] References Cited

U.S. PATENT DOCUMENTS

| | | | |
|---|---|---|---|
| 1,481,703 | 1/1924 | Forbes et al. | 40/572 X |
| 2,182,441 | 12/1939 | Lee | 40/575 |
| 3,056,222 | 10/1962 | Boudouris | 40/572 |
| 4,227,327 | 10/1980 | Thompson | 40/473 |
| 4,384,317 | 5/1983 | Stackpole | 362/812 X |
| 4,441,143 | 4/1984 | Richardson, Jr. | 362/812 |
| 4,555,694 | 11/1985 | Yanagishima | 340/815.06 X |
| 4,697,365 | 10/1987 | Moosbrugger et al. | 40/546 |
| 4,718,185 | 1/1988 | Conlin et al. | 40/442 |
| 4,855,723 | 8/1989 | Fritz et al. | 40/902 X |
| 4,862,613 | 9/1989 | Eyngorn | 40/546 |
| 4,903,172 | 2/1990 | Schöniger et al. | 40/546 X |
| 5,101,329 | 3/1992 | Doyle | 362/812 X |
| 5,107,637 | 4/1992 | Robbins | 40/442 X |

*Primary Examiner*—Kenneth J. Dorner
*Assistant Examiner*—J. Bonifanti
*Attorney, Agent, or Firm*—Norman B. Rainer

[57] ABSTRACT

A flashing advertising sign is provided for indoor use. The sign is of box-like transparent construction having parallel front and rear panels and elongated upper and lower panels having facing retaining channels which slidably secure a flat placard. Photovoltaic cells positioned in the upper panel supply energy to a rechargeable storage battery. A timing circuit periodically directs electrical current from the battery to light-emitting diodes which illuminate the placard.

9 Claims, 4 Drawing Sheets

FLASHING SIGN

BACKGROUND OF THE INVENTION

1. Field of the Invention

This invention relates to advertising signs and more particularly concerns a sign having a plurality of photovoltaically powered flashing lights which draw attention to an advertised message.

2. Description of the Prior Art

It is a generally accepted merchandising principle that a sign having flashing lights is particularly effective in drawing the consumer's attention to the displayed message. Various types of flashing advertising signs are well known in the art. Some advertising signs have characters comprised of flashing light elements. Such signs display a flashing message which alternates between on- and off-conditions. In order to produce this effect, relatively large amounts of voltage are necessary. Other types of flashing signs have a message comprised of opaque letters upon a transparent or translucent panel. A light source is alternately flashed on- and off-behind the lettering to produce a backlit display. Yet other types of signs are comprised of opaque lettering on an opaque surface periodically illuminated by one or more light sources. With each type of sign, enough light must be generated to illuminate the lettering or message significantly brighter than ambient conditions in order for the message to be seen.

Such signs are generally powered by external batteries, generators, or house current. As a practical consideration in retail establishments, batteries and generators are unacceptable and flashing signs generally require a power cord which may have to span great distances from the point of use to a receptacle. The use of power cords presents an additional expense and may create tripping hazards as well as an untidy appearance.

A solar powered illuminated sign is disclosed in U.S. Pat. No. 4,903,172, wherein solar cells, acted upon by outdoor lighting, generate electrical energy which is stored for night-time use. However, it is unlikely that a solar cell small enough to be associated with an indoor display could produce enough voltage to illuminate an indoor sign significantly above ambient conditions.

It is therefore an object of the present invention to provide an indoor advertising sign having flashing lights to attract consumer attention.

It is another object of the present invention to provide a device of the aforesaid nature which is self contained and requires no external power supply.

It is yet another object of the present invention to provide a device of the aforesaid nature which is durable and amenable to low cost manufacture.

SUMMARY OF THE INVENTION

The above and other beneficial objects and advantages are accomplished in accordance with the present invention by a photovoltaically powered flashing sign adapted for use in indoor merchandising displays, said sign comprised of:

a) a boxlike transparent housing having front and rear parallel panels and elongated parallel upper and lower panels, said upper and lower panels having facing retaining channels, b) a substantially flat placard centrally disposed within said housing, having front and rear surfaces, each having an advertising message displayed thereupon, said placard having upper and lower edges slidably engaging said channels, c) photovoltaic energy collection means disposed upon said upper panel, d) a plurality of light emitting diodes disposed within said housing, and e) circuitry encasement means containing:

1) a rechargeable battery adapted to store electrical energy from said collection means, and 2) timing circuit means adapted to receive current from said battery and supply illumination current to said light emitting diodes, said timing circuit adapted to cause on- and off-flashing of said light emitting diodes in a recurring sequence.

In a preferred embodiment, the timing circuit is adapted to create an on-off flashing simultaneously of all light emitting diodes (LEDs). In alternative embodiments, the LEDs may be arranged in banks which are adapted to flash alternately. In yet other embodiments, the LEDs may be illuminated sequentially.

The timing circuit may have additional circuitry to control the duration of flashing activation as well as the on-off interval. The sign may be further equipped with proximity motion detection means to initiate said timing circuit in the presence of a consumer.

In a preferred embodiment, the sign has upper and lower banks of LEDs on both front and rear panels, thereby attracting attention to the sign from both directions.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
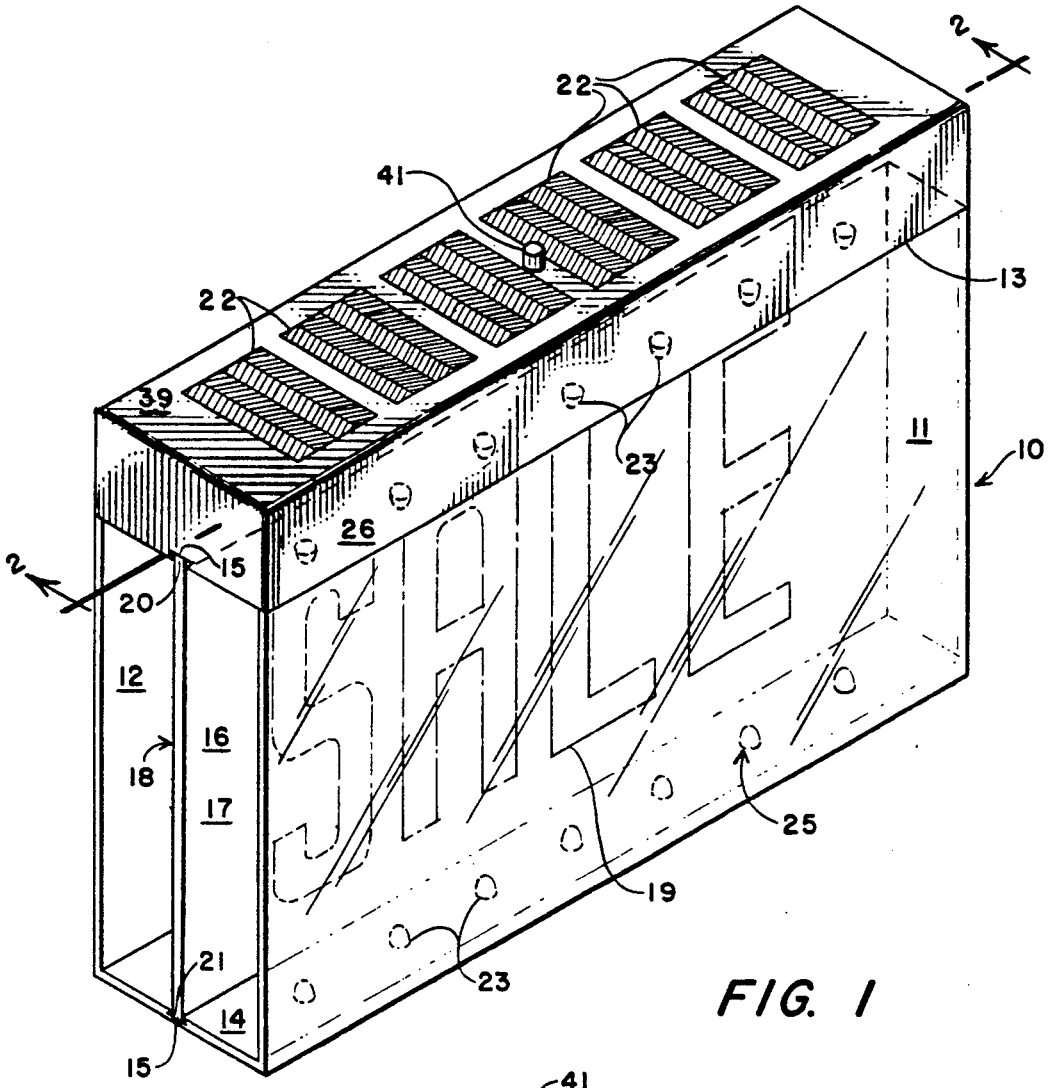
FIG. 1 is a perspective view of an embodiment of the flashing sign of the present invention.
Figure 2:
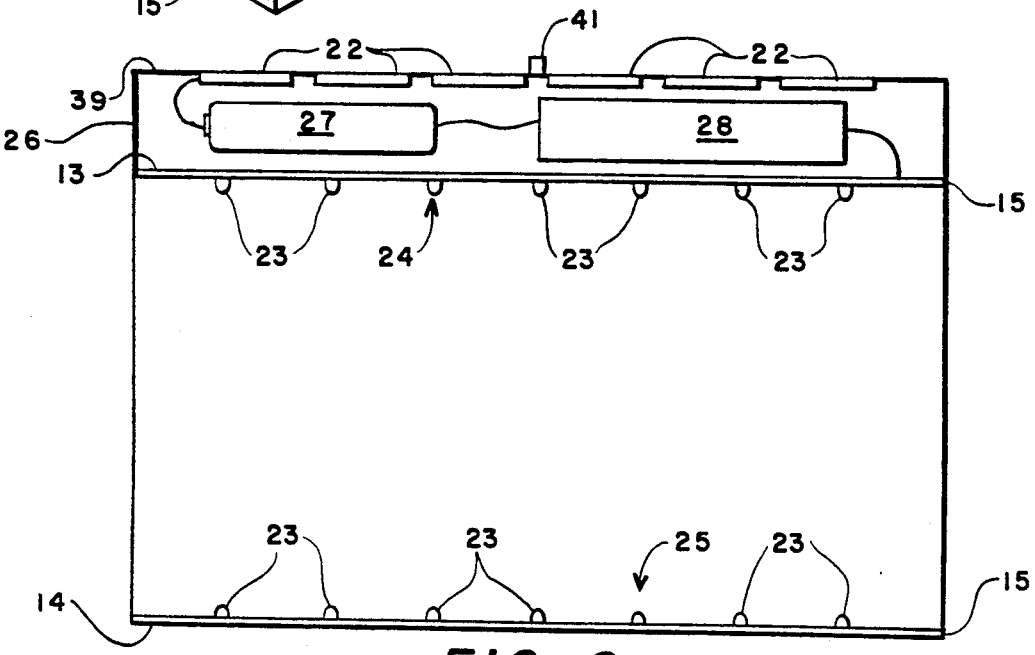
FIG. 2 is a sectional view taken in the direction of the arrows upon line 2—2 of FIG. 1.
Figure 3:
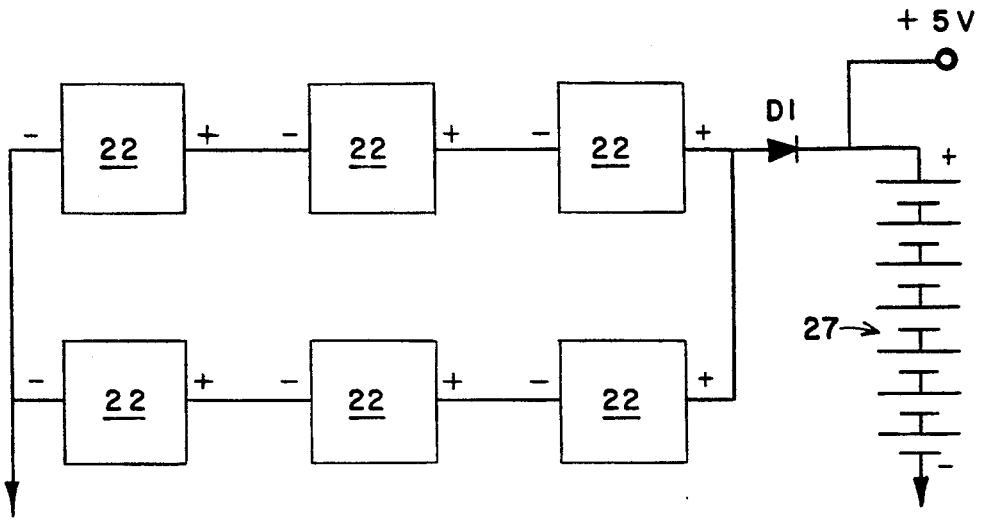
FIG. 3 is a schematic diagram of the energy collection and battery means of the embodiment of FIG. 1.

Referring to FIGS. 1–8, an embodiment of the flashing sign of the present invention is shown comprising a photovoltaically powered flashing sign adapted for use in indoor merchandising displays, said sign comprised of a boxlike transparent housing 10 having substantially rectangular front and rear parallel panels, 11 and 12, respectively, and elongated parallel upper and lower panels, 13 and 14, respectively. Facing elongated channels 15 are recessed into said upper and lower panels in vertically spaced parallel relationship.

Substantially flat placard 16 is centrally disposed within housing 10, and has front and rear surfaces 17 and 18, respectively, said surfaces each having an advertising message 19 displayed thereupon. The placard has upper and lower edges 20 and 21, respectively, slidably engaging said channels 15. Light emitting diodes 23 are disposed within housing 10 in upper and lower banks 24 and 25, respectively.

Circuitry encasement means 26, having top surface 39 is fixedly associated with upper panel 13 and adapted to contain rechargeable battery 27. Photovoltaic energy collection means in the form of solar cell array 22 is disposed upon top surface 39. A proximity detector 41 is also disposed upon top surface 39. The battery is adapted to store electrical energy from solar cell array 22 through Diode D1. Timing circuit 28 is adapted to receive current from said battery and supply illumination current to light emitting diodes 23. Timing circuit 28 is adapted to cause on- and off-flashing of light emitting diodes 23 in a recurring sequence.

Figure 4:
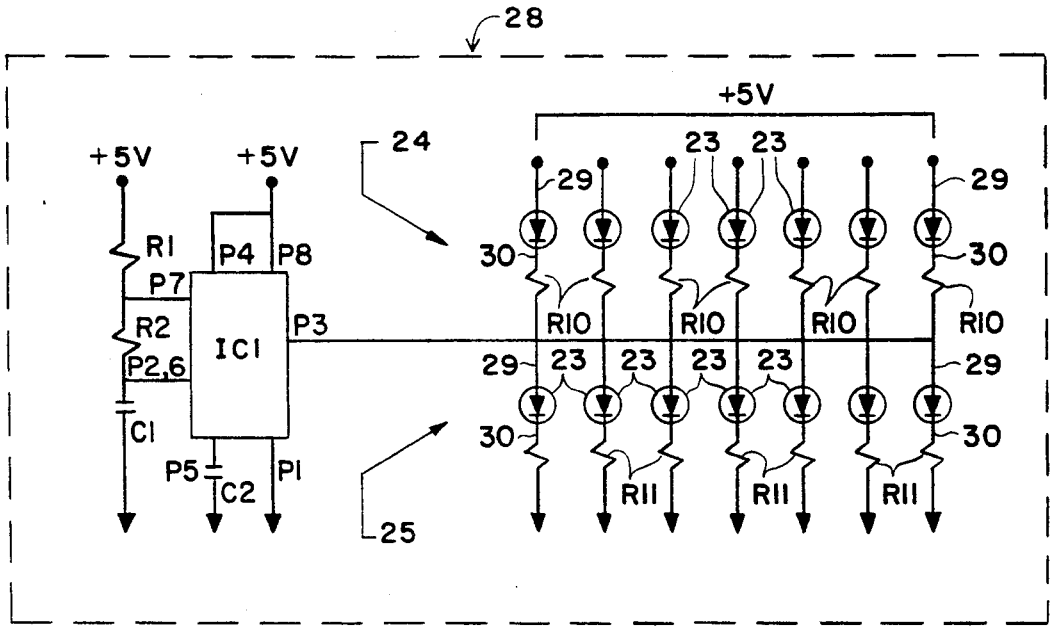
FIG. 4 is a schematic diagram of an embodiment of the timing circuit of the flashing sign of FIG. 1.

In the embodiment of timing circuit 28 shown in FIG. 4, a "555" timer integrated circuit IC1 is utilized as a self-triggering astable multivibrator. In the illustrated embodiment, IC1 receives +5 V on reset pin 4 and voltage pin 8 and is grounded through pin 1. For ease of description throughout this disclosure, electronic connection pins of integrated circuits shall be referred to by their sequential pin numbers, as is standard in the electronics industry. Such pins shall be referred to by number in the text and preceded by a "P" in the corresponding drawing. For example, "pin 4 of IC3" shall refer to "P4" of IC3 in the drawing. Control pin 5 is grounded upon discharge by capacitor C2. Trigger pin 2 and threshold pin 6 are connected in order for the circuit to trigger itself each timing cycle, thereby functioning as an oscillator. Pin 7 receives 5 V voltage through resistor R1, and pins 2 and 6 receive 5 V through resistors R1 and R2. Capacitor C1 is charged through resistors R1 and R2, and discharges voltage from pin 2 to ground in order to trigger output from pin 3. Output from pin 3 of IC1 oscillates between +5 V (high) and 0 V(low). Upper bank of LEDs 24 receives +5 V on anode leads 29, and cathode leads 30 are connected to output pin 3 of IC1 through resistors R10, each associated with an individual cathode lead 30 of an individual LED 23 of upper bank 24. Inversely, lower bank of LEDs 25 has anode leads 29 connected to output pin 3 of IC3, and cathode leads 30 are connected to ground through Resistors R11, each associated with an individual resistor 23 of lower bank 25. In this manner, the banks 24 and 25 will alternately illuminate as voltage output from pin 3 of IC1 oscillates between high and low output. The alternating flashing of LED banks 24 and 25 reduce the total current usage of the circuit by 50%.

Figure 5:
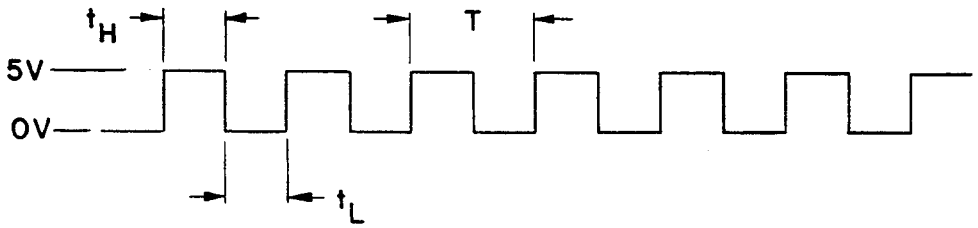
FIG. 5 is an illustration of the waveform generated by the timing circuit of FIG. 4.

The embodiment of the circuit of FIG. 4 will produce the waveform displayed in FIG. 5 wherein:

$t_H = 0.693(R_1 + R_2)C_1$ seconds at high output $t_L = 0.693(R_2)C_1$ seconds at low output $T = t_H + t_L$ seconds total illumination $$F = \frac{1}{T} = \frac{1.44}{(R_1 + R_2)C_1} \text{ hertz (frequency)}$$

Figure 6:
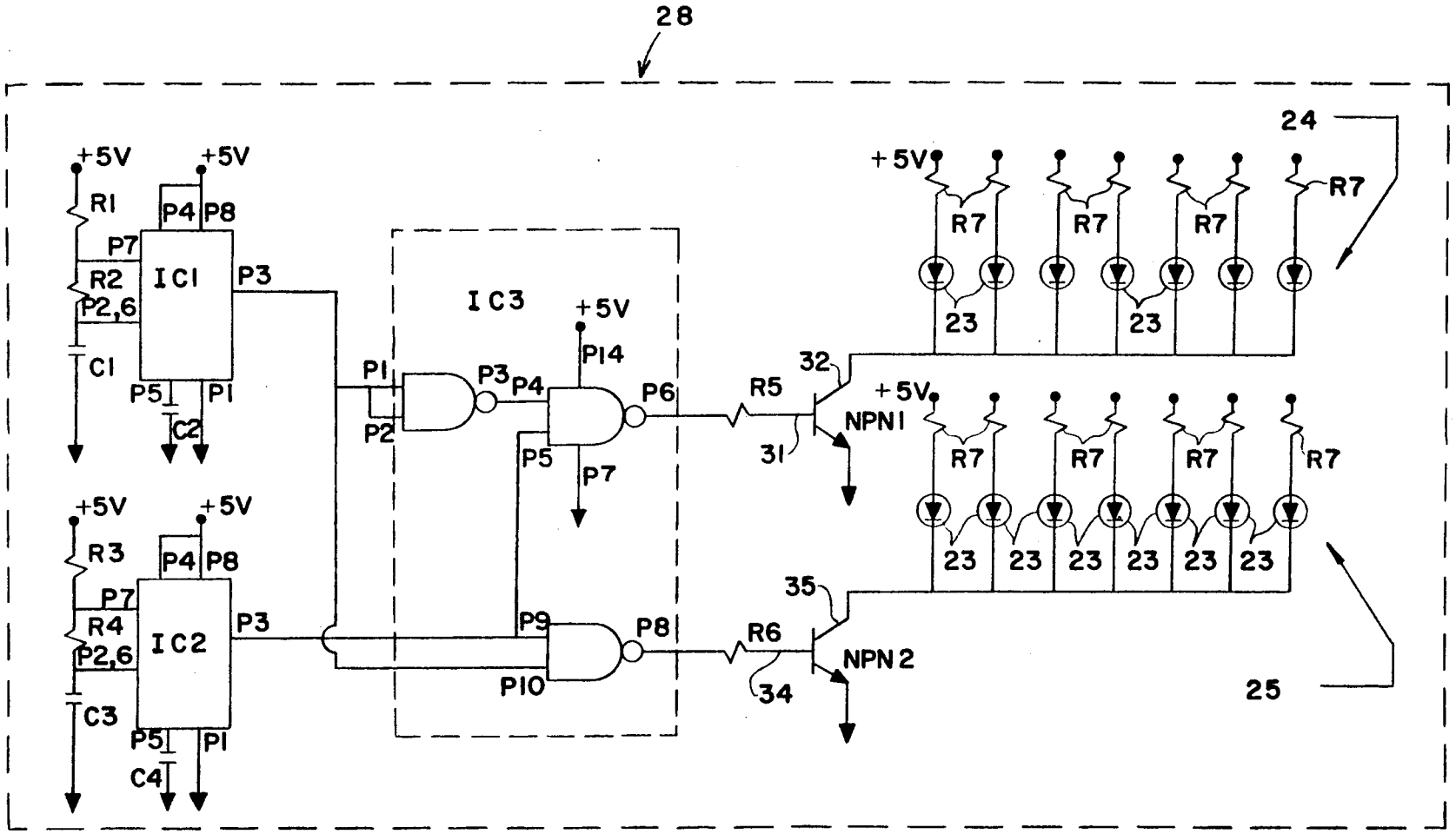
FIG. 6 is a schematic diagram of an alternative embodiment of the timing circuit of the flashing sign of FIG. 1.

In the alternative embodiment of FIG. 6, an additional 555 timer chip IC2 is utilized and its output is mixed with that of IC1 by a 7400 integrated circuit IC3. IC2 is operated at a lower frequency than that of IC1 by resistors R3 and R4, and capacitors C3 and C4. IC3 operates as an Exclusive −OR Gate. Current is output from pin 6 of IC3 through resistor R5 to base lead 31 of transistor NPN1. Collector lead 32 of transistor NPN1 is connected to the cathode leads 30 of the LEDs 23 of upper bank 24 and lower bank 25. Current is likewise output from pin 8 of IC3 through resistor R6 to base lead 34 of transistor NPN2. Collector lead 35 of NPN2 is likewise connected to the cathode leads of LEDs 23 of lower bank 25. Voltage at +5 V is supplied to the anode leads 29 of LEDs 23 through resistors R7. When output from pin 6 of IC3 is low, transistor NPN1 grounds LEDs 23 of upper bank 24 through, thereby illuminating upper bank 24. Likewise when output from pin 8 of IC3 is low, transistor NPN2 grounds, and illuminates LEDs 23 of lower bank 25. In this embodiment, the duration of illumination is shorter for each bank and less energy is consumed than in the embodiment of FIG. 4.

Figure 7:
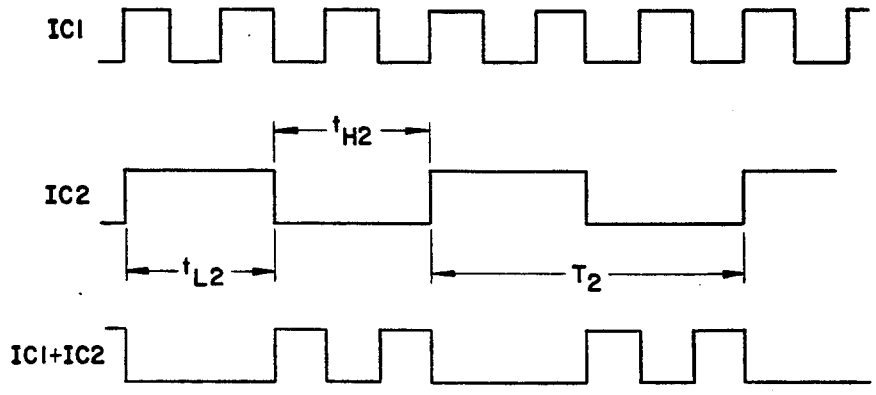
FIG. 7 is an illustration of the waveform generated by the timing circuit of FIG. 6.

The resulting output is illustrated in FIG. 7. The upper bank 24 will illuminate when the output from IC2 is high and the output from IC1 is low. The lower bank 25 will illuminate when the output of IC2 is high and the output of IC1 is high. The operation of the embodiment of the circuit of FIG. 6 is expressed as follows:

$t_{H2} = 0.693(R_3 + R_4)C_3$ seconds high output $t_{L2} = 0.693(R_4)C_3$ seconds low output $T_2 = t_{H2} + t_{L2}$ seconds total output $$F_2 = \frac{1}{T} = \frac{1.44}{(R_3 + 2R_4)C_3} \text{ Herz (frequency)}$$

Figure 8:
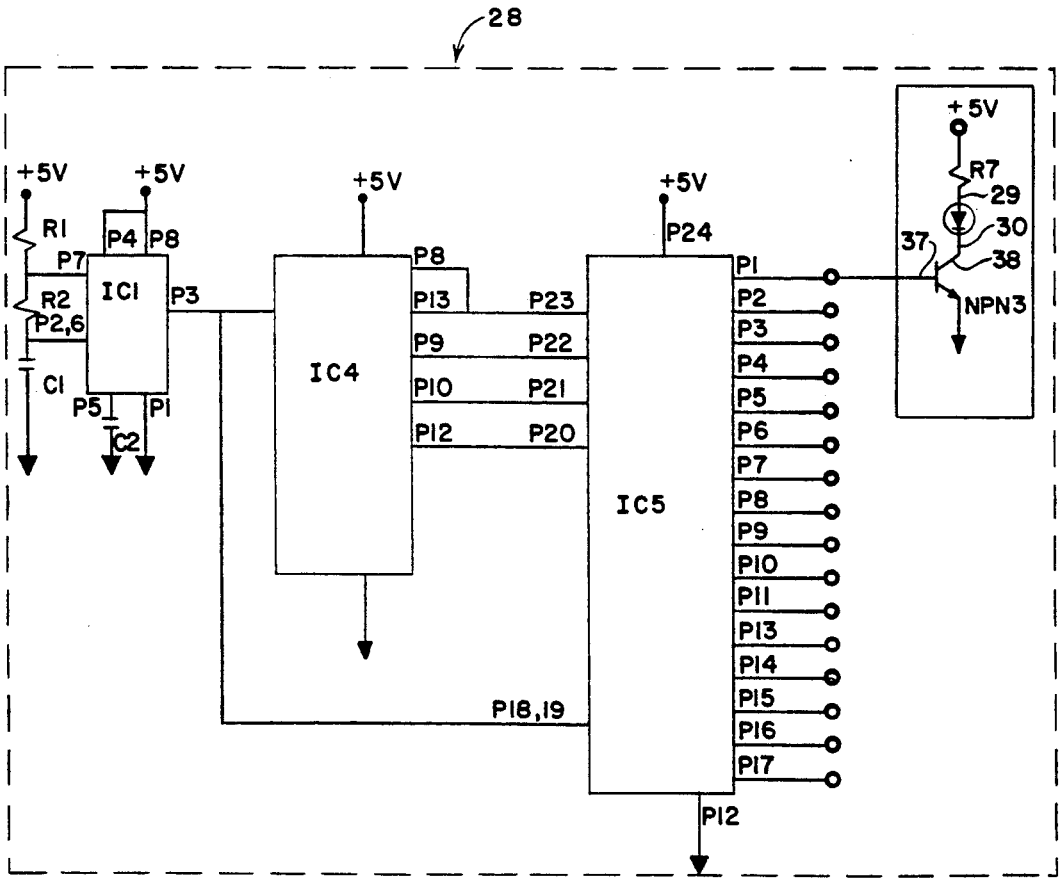
FIG. 8 is a schematic diagram of a second alternative embodiment of the timing circuit of the flashing sign of FIG. 1.

In the alternative embodiment of FIG. 8, a single 555 timer circuit is used identically as in the embodiment of FIG. 4. However, a 74LS93 4-bit binary counter integrated circuit IC4 is connected to output pin 3 of IC1. The output pins 8, 9, 10, 12, and 13 are input to pins 20–23 of 4-line to 16-line 74LS154 demultiplexer/decoder integrated circuit IC5. IC5 has sixteen output pins, each being connected to the base lead 37 of a transistor NPN3 which controls a single LED 23 through the connection of collector lead 38 to cathode lead 30. As counter IC4 proceeds through its counts, each output line of the decoder IC5 goes to low output in a sequential order, thereby illuminating each LED 23 sequentially. Binary counter IC4 resets itself with every completed sequence. In this manner 1/16 the amount of current is used than if all LEDs remained illuminated. The result is an eye catching flashing of lights on the sign with a minimal current draw.

The flashing embodiments allow for the operation of the flashing sign in the relatively low light environment of an indoor retail establishment where current is limited to that produced by solar cell array 22.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A photovoltaically powered flashing sign adapted for use in indoor merchandising displays, said sign comprised of:

a) a boxlike transparent housing having front and rear parallel panels and elongated parallel upper and lower panels, said upper and lower panels having facing retaining channels, b) a substantially flat placard centrally disposed within said housing, having front and rear surfaces, each having an advertising message displayed thereupon, said placard having upper and lower edges slidably engaging said channels, c) photovoltaic energy collection means directed upwardly from said sign, d) a plurality of light emitting diodes disposed within said housing, and e) circuitry encasement means containing:

1) a rechargeable battery adapted to store electrical energy from said collection means, and 2) timing circuit means adapted to receive current from said battery and supply illumination current to said light emitting diodes, said timing circuit adapted to cause on- and off-flashing of said light emitting diodes in a recurring sequence.

2. The sign of claim 1 wherein all said light emitting diodes simultaneously flash on and off.

3. The sign of claim 1 wherein said timing circuit means controls the duration of flashing and the time interval between flashing.

4. The sign of claim 1 further equipped with proximity detection means interactive with said timing circuit means for causing flashing in the close presence of a person adjacent said merchandising displays.

5. The sign of claim 1 having upper and lower banks of light emitting diodes associated with both said front and rear panels, thereby illuminating the placard from both directions.

6. The sign of claim 1 wherein a first "555" timer integrated circuit is utilized as a self-triggering astable multivibrator.

7. The sign of claim 6 wherein a second "555" timer interacts with said first "555" timer by way of a 7400 integrated circuit.

8. The sign of claim 6 wherein a 4-bit binary counter integrated circuit is interactive with said "555" timer.

9. The sign of claim 1 wherein said circuitry encasement means has a top surface and is disposed upon the upper panel of said housing, and said photovoltaic energy collection means is disposed upon said top surface.

* * * * *